United States Patent [19]

Knoski

[11] 4,364,531

[45] Dec. 21, 1982

[54] ATTACHABLE AIRFOIL WITH MOVABLE CONTROL SURFACE

[76] Inventor: Jerry L. Knoski, 9001 E. Calle Bogota, Tucson, Ariz. 85715

[21] Appl. No.: 195,695

[22] Filed: Oct. 9, 1980

[51] Int. Cl.[3] ..... F42B 13/32

[52] U.S. Cl. ..... 244/3.27; 244/49

[58] Field of Search ..... 244/3.24–3.3, 244/46, 49, 218

[56] References Cited

U.S. PATENT DOCUMENTS

| | | | |
|---|---|---|---|
| 2,074,897 | 3/1937 | Everts . | |
| 2,162,066 | 6/1939 | De Asis . | |
| 2,275,777 | 3/1942 | Lane et al. | 244/218 |
| 2,297,130 | 9/1942 | Bomas | 244/3.27 |
| 3,188,957 | 6/1965 | Petre . | |
| 3,463,420 | 8/1969 | Butler et al. | 244/49 |
| 3,599,904 | 8/1971 | Condit et al. . | |
| 3,602,459 | 8/1971 | Pesarin et al. . | |
| 3,633,846 | 1/1972 | Biggs, Jr. | 244/3.27 |
| 3,776,490 | 12/1973 | Weis . | |
| 3,990,656 | 11/1976 | Minnich | 244/3.27 |
| 4,022,403 | 5/1977 | Chequet . | |
| 4,090,684 | 5/1978 | Look . | |
| 4,106,727 | 8/1978 | Ortell | 244/218 |

*Primary Examiner*—Harold J. Tudor

*Attorney, Agent, or Firm*—Donald J. Singer; Jacob N. Erlich

[57] ABSTRACT

An attachable airfoil for use on an airborne vehicle or payload having a plurality of joined, nestable sections which can expand from a collapsed, streamlined position adjacent the vehicle or payload to a fully extended airfoil configuration. In addition, the airfoil incorporates therein a movable control surface which by appropriate remote actuation can be utilized to provide controlled flight of the airborne vehicle or payload.

7 Claims, 10 Drawing Figures

FIG. 1
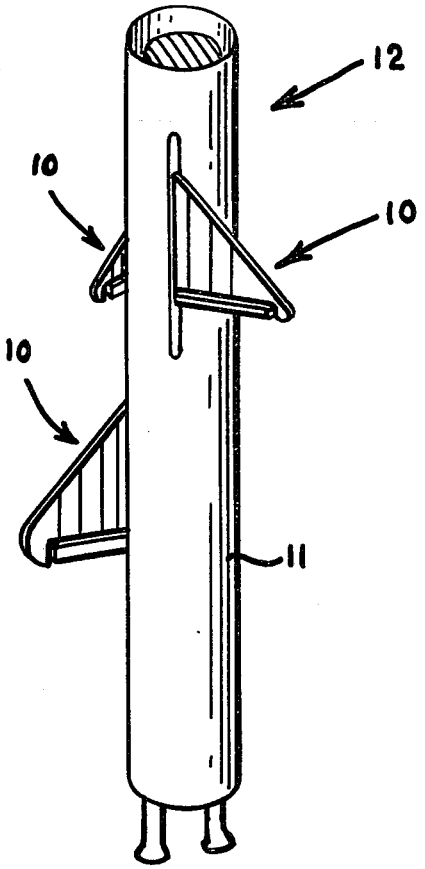
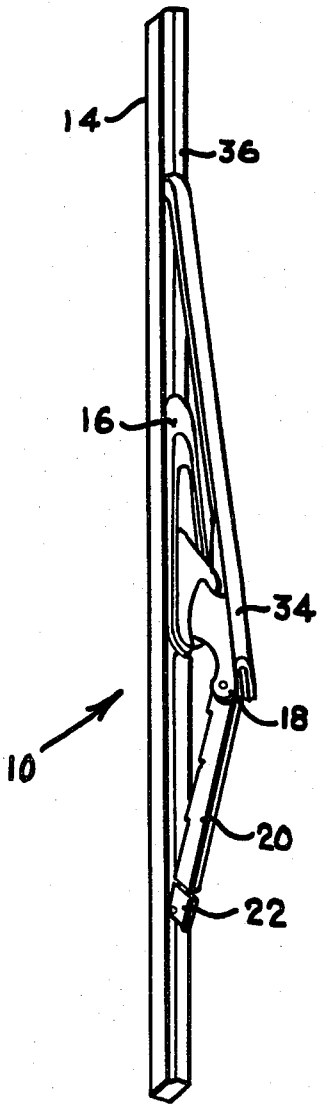
FIG. 2

FIG. 3
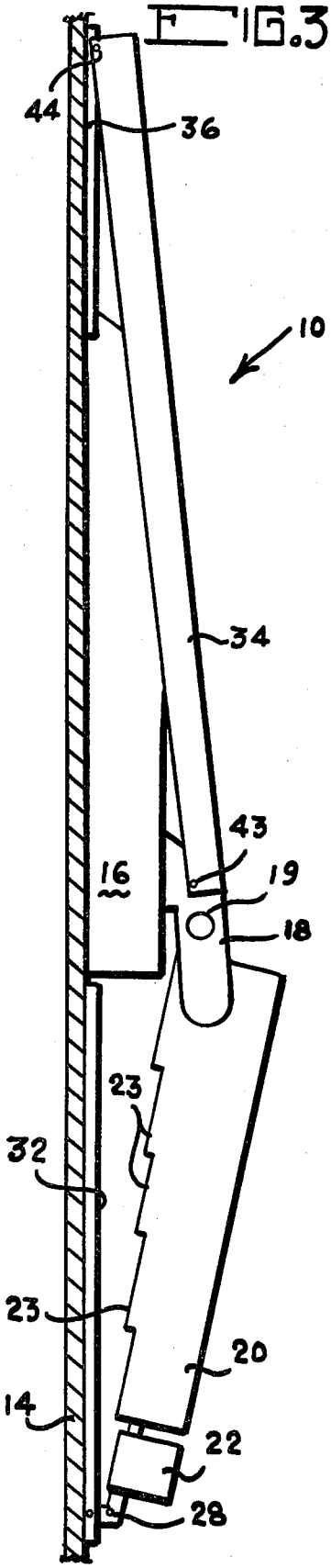
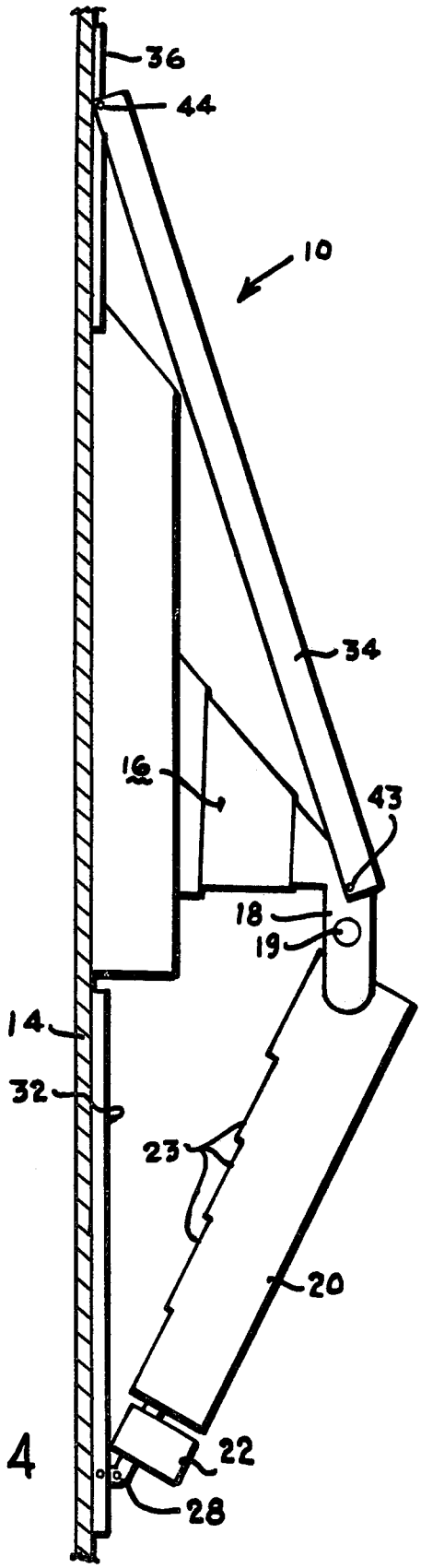
FIG. 4

FIG. 7
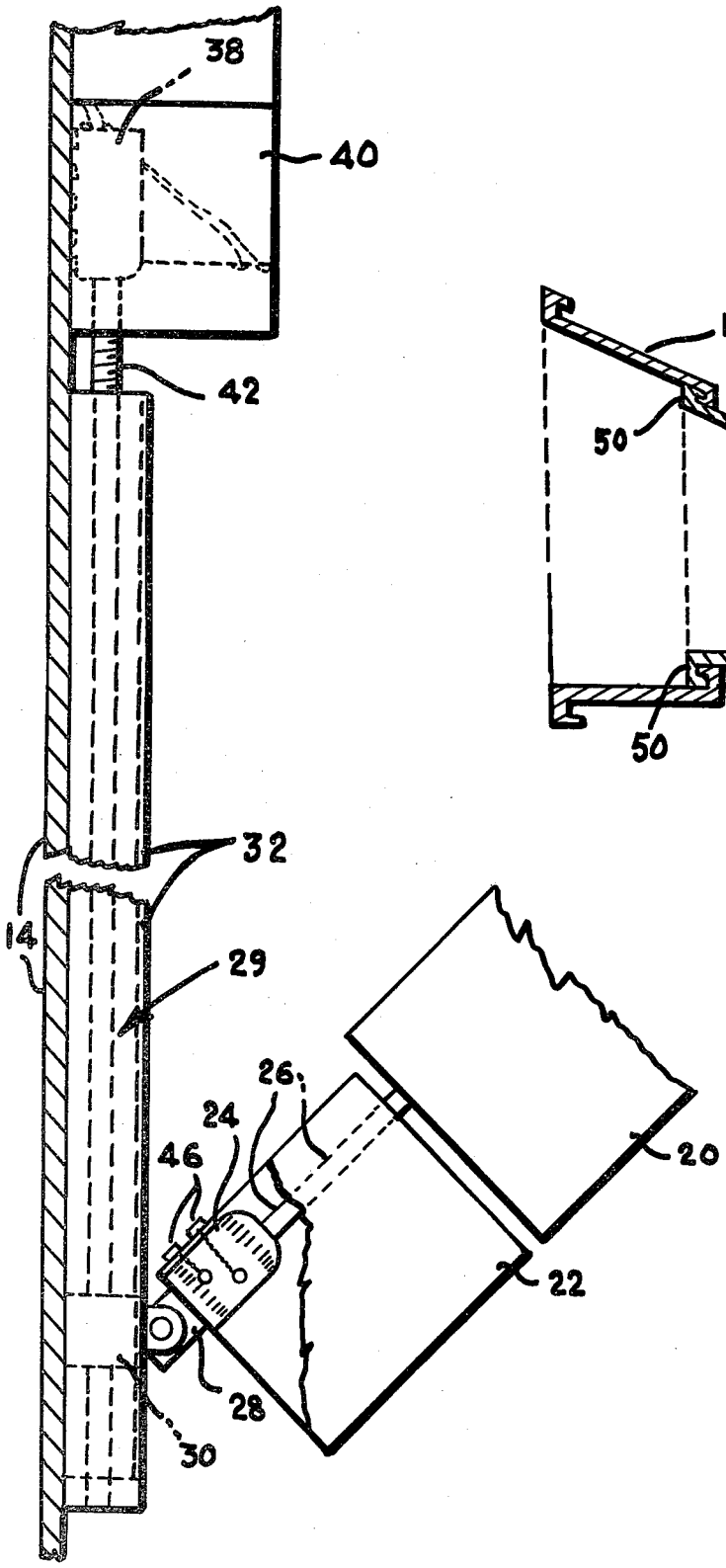
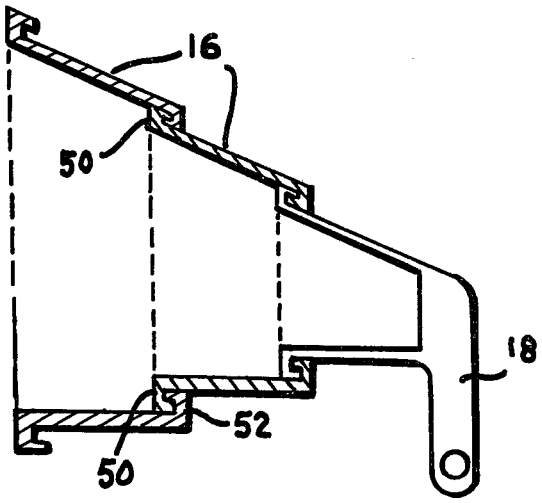
FIG. 8

ATTACHABLE AIRFOIL WITH MOVABLE CONTROL SURFACE

STATEMENT OF GOVERNMENT INTEREST

The invention described herein may be manufactured and used by or for the Government for governmental purposes without the payment of any royalty thereon.

BACKGROUND OF THE INVENTION

This invention relates generally to airfoils, and, more particularly, to an expandable airfoil, having a movable control surface, which can be temporarily attached to any airborne body such as a missile stage or air drop payload which requires controlled flight.

In many instances it is desirable to recover, intact, an airborne vehicle or body which has been dropped from space or high altitude. For example, under certain circumstances it is necessary to retrieve a depleted missile strength for inspection or reuse at a future time. In addition, in many instances in the air dropping of payloads it is also necessary to not only control the flight of the payload but also recover the payload for subsequent use. Furthermore, it may be desirable to have the airfoil structure retract against the fuselage of a tube launched missile prior to controlled guidance of the missile.

It is uneconomical to construct all such missile stages, air drop payloads and/or other such airborne vehicles with airfoils if, in fact, in some instances controlled landings are unnecessary. It therefore would be extremely desirable to provide attachable airfoils for appropriate utilization so as to provide controlled flight to airborne vehicles of the type set forth hereinabove. Additionally, it would be even more desirable to be able to reuse the airfoil for subsequent controlled landings. Unfortunately, a reliable, expandable, attachable airfoil having a movable control surface is currently unavailable.

SUMMARY OF THE INVENTION

The instant invention overcomes the problems encountered in the past by providing an attachable, expandable airfoil having a movable control surface which can be readily utilized with any airborne vehicle.

Although the airfoil of this invention is primarily designed to be attached to the lower stages of missiles thereby enabling recovering of the missile stage, this airfoil is also adaptable for use with any airborne vehicle or payload which requires a controlled soft landing in order for the vehicle or payload to be recovered and reused. In addition, as a result of the controllability of the airborne vehicle, more reliably controlled flights of such vehicles are now possible.

The attachable airfoil of this invention is made up of an airfoil mount which can be removably secured to the fuselage of an airborne vehicle of the type set forth hereinabove. Operably secured within the airfoil mount are a plurality of telescopic sections or elements which initially are in the collapsed or streamlined position adjacent the fuselage. By subsequent actuation of the airfoil, the telescopic sections can be expanded to form the appropriate airfoil configuration. Expansion of the airfoil telescopic sections can be accomplished by mechanical and/or pneumatic means.

After staging, for example, of a missile, a command from a radio controlled or barometric switch activates the airfoil of this invention, expanding the telescopic sections to their fully extended position. Upon full extension of the airfoil, a control surface forming part of the airfoil is capable of movement in response to appropriate radio control commands. Any number of such airfoils may be utilized with the airborne vehicle. For example, three to five such airfoils of different sizes attached to an airframe can control flight about three different axes and thereby enable the airframe to glide to a controlled soft landing.

It is therefore an object of the invention to provide an airfoil which is capable of attachment to an airborne vehicle or the like.

It is another object of this invention to provide an attachable airfoil which includes a movable control surface.

It is a further object of this invention to provide an attachable airfoil with movable control surface that is responsive to radio control commands.

It is still another object of this invention to provide an attachable airfoil with movable control surface that is capable of expansion from a compact streamlined position adjacent the fuselage of an airborne vehicle to a full airfoil configuration.

It is still a further object of this invention to provide an attachable airfoil with movable control surface which is economical to produce and which utilizes conventional, currently available components that lend themselves to standard, massproducing manufacturing techniques.

For a better understanding of the present invention together with other and further objects thereof, reference is made to the following description taken in conjunction with the accompanying drawing and its scope will be pointed out in the appended claims.

DETAILED DESCRIPTION OF THE DRAWING

FIG. 1 is a pictorial representation of an airborne vehicle such as a missile stage which has attached thereto a plurality of the airfoils of this invention;

FIG. 2 is a pictorial representation of the airfoil of this invention shown in the partially extended position;

FIG. 3 is a side elevational view, shown partly in cross-section, of the airfoil of this invention shown in its collapsed or streamlined position;

FIG. 4 is a side elevational view, shown partly in cross-section, of the airfoil of this invention in an intermediate stage of extension;

FIG. 7 is a side elevational view of the mechanical mechanism of the airfoil of this invention utilized for extending the airfoil;

FIG. 8 is a side elevational view, shown partly in cross-section, of a plurality of the telescoping sections of the airfoil of this invention;

DETAILED DESCRIPTION OF THE PREFERRED EMBODIMENT

Figure 5:
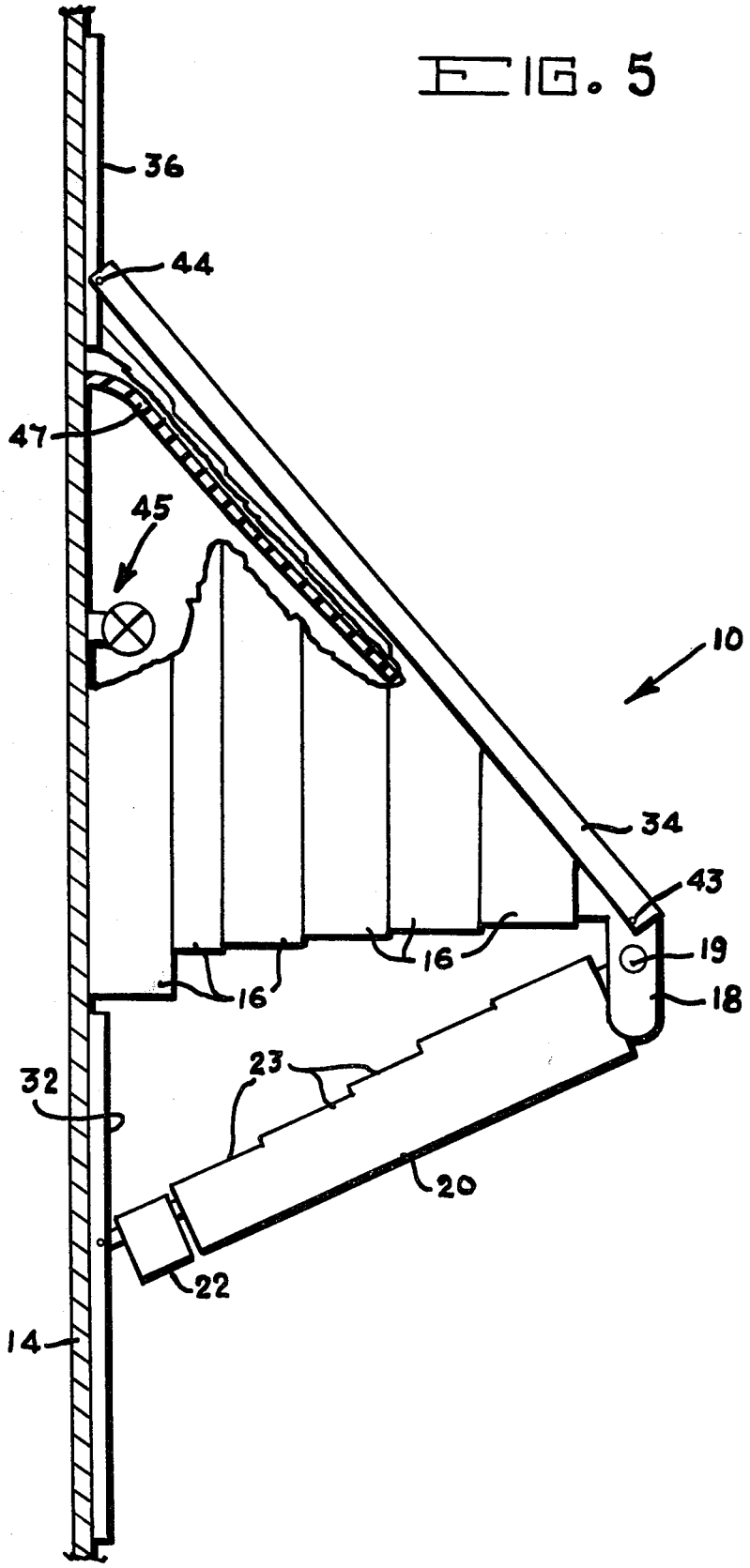
FIG. 5 is a side elevational view, shown partly in cross-section, of the airfoil of this invention shown in its almost fully extended position.

Reference is now made to FIG. 1 of the drawing which pictorially illustrates a plurality of the attachable airfoils 10 of this invention situated in place, in their fully extended position, upon the fuselage 11 of any suitable airborne vehicle 12 such as a missile stage or payload. More clearly illustrating airfoil 10 of this invention is the pictorial representation set forth in FIG. 2 of the drawing in which airfoil 10 is shown in a partially extended position.

Figure 6:
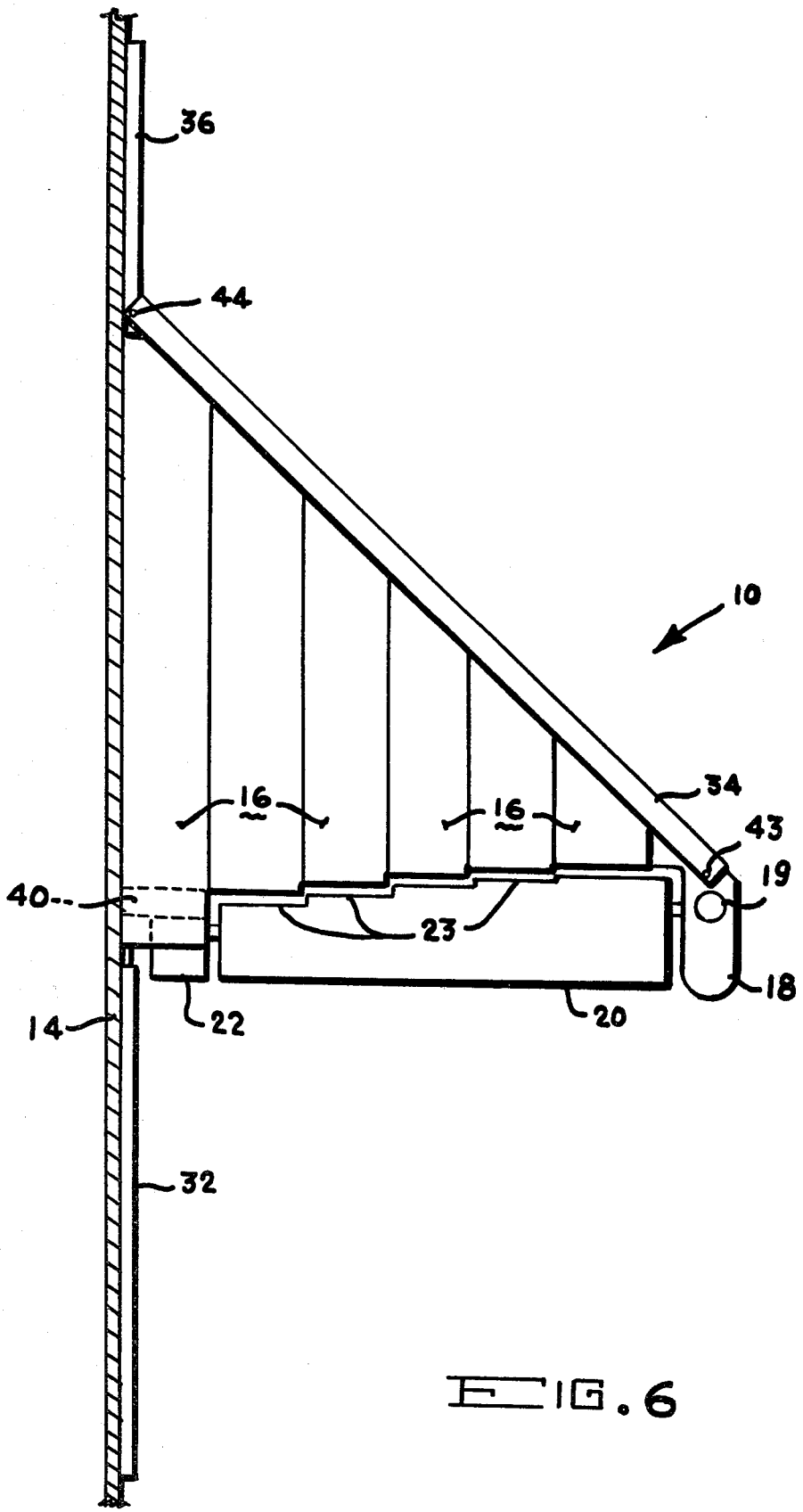
FIG. 6 is a side elevational view, shown partly in cross-section, of the airfoil of this invention in its fully extended position.

For a more detailed description of this invention reference is now made to FIGS. 3 through 6 of the drawing in which FIG. 3 illustrates airfoil 10 in its collapsed or streamlined position, FIGS. 4 and 5 are representative of intermediate extensions of airfoil 10 and FIG. 6 is a representation of airfoil 10 of this invention in its fully extended and operational position.

As illustrated in the above Figures airfoil 10 is made up of an airfoil mount 14 which can be removably secured by any suitable attachment means such as bolts (not shown) to the outer surface or fuselage 11 of an airborne vehicle 12 as indicated in FIG. 1 of the drawing. Secured substantially at the midpoint of mount 14 are a plurality of extendable telescopic sections or elements 16 which in the collapsed and intermediate positions of airfoil 10 are nested within one another as pictorially illustrated in FIG. 2. The full extension of airfoil 10 is illustrated in FIG. 6 of the drawing.

The outermost telescopic section or element 16 has secured thereto an outstanding arm 18. Pivotally secured to outstanding arm 18 in a conventional manner such as with bolt 19 is one end of a control surface 20. Control surface 20 is formed of a substantially hollow element having a plurality of support ribs 21 therein (one of which being shown in FIG. 10). In addition, control surface 20 has a plurality of indentations 23 which align with telescopic sections 16 as shown in FIGS. 3–6. Although the main function of control surface 20 is to control the flight of airborne vehicle 12, control surface 20 also adds substantial structural support to telescopic sections 16.

Figure 10:
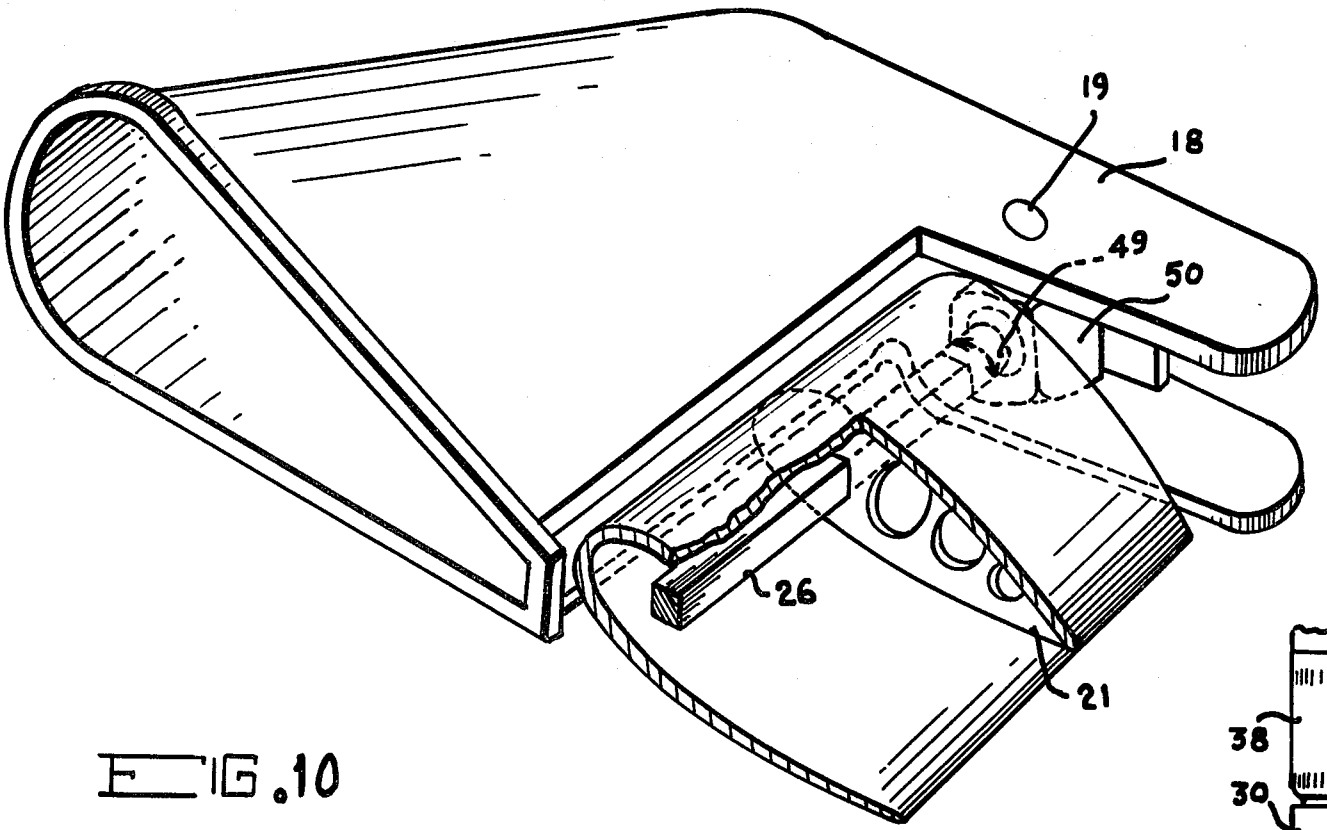
FIG. 10 is a pictorial representation, shown partly in cross-section, of one of the telescoping sections of the airfoil of this invention and illustrating the control rod for the movable control surface.

Forming the other end of control surface 20 is a housing 22 which encloses therein any suitable control surface drive motor 24 and drive shaft 26 in a manner more clearly illustrated in FIGS. 7 and 10 of the drawing. An extension 28 formed as part of housing 22 pivotally secures control surface 20 to a mechnaical drive mechanism 29.

Drive mechanism 29 is made up of a wormgear 30 pivotally secured to extension 28 of housing 22 and slidably mounted within a wormgear drive guide 32. Drive guide 32 is fixedly secured to airfoil mount 14 as clearly illustrated in FIG. 7 of the drawing. Any suitable wormgear drive motor 38, located within a housing 40 attached to mount 14, drives a wormgear drive shaft 42 to which is operably attached wormgear 30. Rotation of shaft 42 provides bidirectional movement of wormgear 30 within drive guide 32 thereby causing extension or contraction of control surface 20.

In addition to the support rendered by control surface 20, additional support for telescopic sections 16 is in the form of a leading edge 34. Leading edge 34 is formed of an elongated streamlined element pivotally secured at one end 43 to outstanding arm 18 and slidably mounted at the other end 44 within a leading edge slide 36. Leading edge slide 36 is fixedly secured to airfoil mount 14.

The leading edge 34 serves two purposes, (1) it provides streamlining for the airfoil 10 in both the stowed position illustrated in FIG. 3 and the extended position illustrated in FIGS. 4 through 6, and (2) it provides rigidity to airfoil 10 in the extended position illustrated in FIG. 6. As the airfoil sections 16 are being extended the smooth leading edge 34, which is pivoted at outstanding arm 18, moves down slide 36 until the airfoil is fully extended whereupon it snap locks into place in a conventional manner.

Extension of telescopic sections 16 takes place in one of two ways or a combination of both. This extension is accomplished mechanically, through wormgear drive mechanism 29 or pneumatically, by the utilization of stored, exhaust or by-product gases directed through a gas valve 45 in order to pressurize a bladder 47 which lines the interior of telescopic sections 16 in the manner shown in FIG. 5 of the drawing.

Activation of the airfoil 10 of this invention takes place upon command, either from ground radio control signals or a barometric switch (not shown), by opening gas valve 45 which allows gas to pressurize bladder 47 within sections 16 of airfoil 10. Once a specified pressure is achieved, or after a short delay, the wormgear drive motor 38 is started. As the wormgear drive shaft 42 turns, the threads thereon move wormgear 30 along wormgear drive guide 32 thereby putting positive pressure on outstanding arm 18 airfoil 10. This action moves telescopic sections 16 to their extended position. It should be realized that although the combination of mechanical and pneumatic means have been described above to extend airfoil 10, it is possible to use either mechanical or pneumatic means alone for the extension, if desired.

Movement between sections 16 during the extension thereof takes place by the interengagement of an external lip 50 on section 16 with an internal lip 52 of an adjacent section 16 as illustrated in FIG. 8 of the drawing. Continued internal gas pressure and/or the external mechanical force applied to telescopic sections 16 causes the outermost section 16 to pull the next telescopic section 16 from its stowed position in the manner illustrated in FIGS. 3 through 5 of the drawing. Each of the airfoil sections 16 is extended in the same manner until airfoil 10 is completely extended as illustrated in FIG. 6 of the drawing. Complete expansion of airfoil 10 is detected by either a limit switch (not shown) on outermost airfoil section 16 or when the control surface motor housing 22 makes electrical contact at the top of the wormgear travel.

Figure 9:
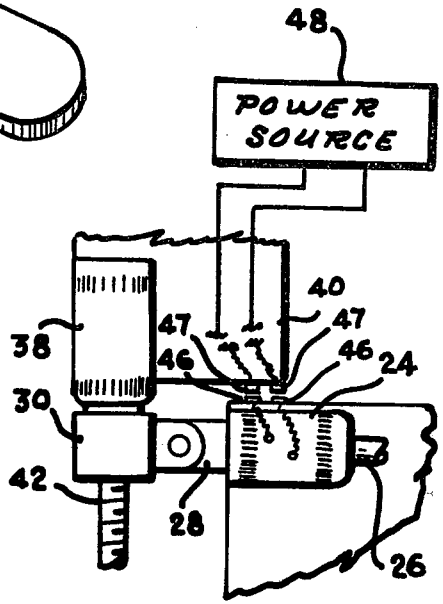
FIG. 9 is a side elevational view showing the motor for controlling the movable control surface of the airfoil of this invention.

Once airfoil 10 is fully extended as illustated in FIG. 6 of the drawing electrical contacts 46 from drive motor 24 located on the inside portion of control surface motor housing 22, as shown in FIGS. 7 and 9 of the drawing, engage the contacts 47 of a conventional radio controlled power source 48. When this electrical contact is made control surface drive motor 24 is ready to respond to command. The control surface drive motor 24 and housing do not turn but remain stationary within housing 22.

The control surface drive motor 24 as illustrated in FIGS. 7 and 10 of the drawing moves the control surface 20 by means of a drive shaft 26 which is pivotally secured at one end 49 on a dual axis joint 50. Dual axis joint 50 is pivotally secured within outstanding arm 18 on outermost telescopic section 16 by bolt 19. Drive shaft 26 is securely attached to inner support ribs 21 of the movable control surface 20. Therefore, when the control surface drive motor 24 turns shaft 26 as a result of a command, control surface 20 moves accordingly. Consequently, movement of airborne body or vehicle 12 to which the airfoil 10 of this invention is attached can be radio controlled for controlled flight and subsequent soft landing. Since airfoil 10 of this invention is a self contained unit and can be easily attached to any number of airborne vehicles 12, it can be utilized numerous times during its life expectancy.

Although this invention has been described with reference to a particular embodiment, it will be understood to those skilled in the art that this invention is also capable of further and other embodiments within the spirit and scope of the appended claims.

I claim:

1. An attachable, self contained, expandable air foil for use with an airborne body comprising:

a longitudinally extending mount, said mount being capable of removable attachment to the outer surface of said airborne body;

means connected at one end thereof to said mount for expanding into an airfoil configuration, said airfoil configured means including a plurality of telescopic sections, each of said telescopic sections being of decreasing size in a transverse direction away from said longitudinally extending mount and capable of being nested within one another in a retracted position adjacent said mount and expandable from said mount to a fully extended position in said direction transverse to said longitudinally extending mount;

means operably connected between the other end of said airfoil configured means and said mount for providing a movable control surface for said airfoil configured means in order to control the flight of said airborne vehicle;

means operably connected between said expandable airfoil configured means and said mount for extending said airfoil configured means from said retracted position adjacent said mount to said fully extended position; and means operably connected to said movable control surface means for providing controlled movement of said control surface means relative to said airfoil configured means only when said airfoil configured means is in its fully extended position.

2. An attachable, self-contained, expandable airfoil as defined in claim 1 wherein said movable control surface means comprises an element in the form of an airfoil-shaped control surface and an elongated rod fixedly secured thereto, said elongated rod being pivotally as well as rotatably secured at one end thereof to said other end of said airfoil configured means and said elongated rod being secured at the other end thereof to said means for moving said control surface means.

3. An attachable, self contained, expandable airfoil as defined in claim 2 wherein said means for extending said airfoil configured means comprises a mechanized worm gear assembly located with said mount, said worm gear assembly being connected to said control surface means in order to move said control surface means and thereby move said airfoil configured means from said retracted position to said fully extended position.

4. An attachable, self contained, expandable airfoil as defined in claim 3 wherein said means for extending said airfoil configured means further comprises a liner formed within said telescopic sections and means for providing a fluid to the interior of said liner in order to expand said liner and thereby extend said telescopic sections.

5. An attachable, self contained, expandable airfoil as defined in claim 4 further comprising means positioned on said mount for activating said means for moving said control surface means when said airfoil configured means are in said fully extended position.

6. An attachable, self contained, expandable airfoil as defined in claim 5 further comprising means operably connected between said other end of said airfoil configured means and said mount for forming a streamlined leading edge and additional structural support for said airfoil configured means.

7. An attachable, self contained, expandable airfoil as defined in claim 6 wherein said control surface element is made of increasing widths in a direction towards said other end of said airfoil configured means in order to accommodate said decreasing sized telescopic sections.

* * * * *